US007017755B1

(12) United States Patent
Nakamura et al.

(10) Patent No.: US 7,017,755 B1
(45) Date of Patent: Mar. 28, 2006

(54) LARGE COATING LUMP REMOVING DEVICE

(75) Inventors: Masura Nakamura, Nishikubiki-gun (JP); Tsuyoshi Yamamoto, Nishikubiki-gun (JP); Asaaki Nishioka, Nishikubiki-gun (JP); Shigetoshi Toyooka, Nishikubiki-gun (JP); Yasufumi Matsuo, Nishikubiki-gun (JP); Shunichi Nagasaki, Nishikubiki-gun (JP)

(73) Assignee: Denki Kagaku Kogyo Kabushiki Kaisha, Tokyo (JP)

( * ) Notice: Subject to any disclaimer, the term of this patent is extended or adjusted under 35 U.S.C. 154(b) by 276 days.

(21) Appl. No.: 10/203,634

(22) PCT Filed: May 31, 2000

(86) PCT No.: PCT/JP00/03510

§ 371 (c)(1),
(2), (4) Date: Dec. 2, 2002

(87) PCT Pub. No.: WO01/62684

PCT Pub. Date: Jun. 30, 2001

(30) Foreign Application Priority Data

Feb. 23, 2000 (JP) ..... 2000-045307

(51) Int. Cl.
*B07B 1/46* (2006.01)

(52) U.S. Cl. ..... 209/660; 209/238; 209/379; 209/262; 209/660; 106/739

(58) Field of Classification Search ..... 209/233, 209/234, 238, 262, 263, 379, 659, 660, 674, 209/675

See application file for complete search history.

(56) References Cited

U.S. PATENT DOCUMENTS 3,197,887 A * 8/1965 Kayatz ..... 34/164
3,892,044 A * 7/1975 Kayatz ..... 34/432
5,626,089 A * 5/1997 Schneider et al. ..... 110/281
5,976,243 A * 11/1999 Oates et al. ..... 106/767

FOREIGN PATENT DOCUMENTS

DE 10216926 A1 * 11/2003
JP 3048050 3/2000

* cited by examiner

*Primary Examiner*—Eileen D. Lillis
*Assistant Examiner*—Jonathan R. Miller
(74) *Attorney, Agent, or Firm*—Armstrong, Kratz, Quintos, Hanson & Brooks, LLP

(57) ABSTRACT

Rear ends of pushing rods 40 are axially connected to a support base 50, which is movably engaged with guide rails 60. A drive unit 70 is disposed to rotatably move wire belts 74 between wheels 73 and 71 at longitudinal front and rear ends of the guide rails 60, and the support base 50 is connected to the wire belts 74. The drive unit 70 is activated to guide the pushing rods 40 by the guide rails 60 so to make pushing and pulling operation of the pushing rods 40. A door 33 which is disposed at the back wall of a static grate 31 in a clinker cooler 30 is opened to fit the pushing rods 40 into a seal material 34 on the opening to push a large lump of coating C2 retained on the static grate 31. The pushing rods 40 have a double tube structure and are cooled by injecting cooling water from supply pipes 45.

By configuring as described above, there is provided an advantageous apparatus for removing large lumps of coating which can remove the large lumps of coating retained in a clinker cooling section with reliability without manually working and automate the removing work, and which excels in maintenance and management.

7 Claims, 7 Drawing Sheets

LARGE COATING LUMP REMOVING DEVICE

TECHNICAL FIELD

The present invention relates to an apparatus for removing large lumps of coating, which is mounted to a static grate section of a cooling section (clinker cooler) in cement clinker burning, and more particularly to an apparatus for removing large lumps of coating, which prevents a large lump of coating, which has adhered to an inner wall of a rotary kiln (kiln) and separated to drop from there, from being retained on the static grate section.

BACKGROUND ART

It is known well that cement includes limestone and clay as main materials and it is produced by grinding raw materials such as limestone, clay and iron oxide in a mill, mixing them appropriately, burning the mixed materials in a kiln, quickly cooling by air within a clinker cooler to produce sintered particles called clinker, adding gypsum and the like to the clinker, pulverizing in a finish mill, and removing powder having a predetermined grain size by an air separator.

FIG. 7 is a structure diagram showing one example of a conventional cement clinker burning system.

In cement clinker burning, a raw material C0 is charged into and preheated in a suspension preheater 10 having several heat exchangers 11 connected and then taken into a kiln 20. For example, the kiln 20 has a cylindrical furnace with an overall length of about 100 m disposed in an inclined position of about 4% and its interior is heated to about 1450° C. and rotated.

Clinker C1 is discharged as the kiln 20 is rotated and drops onto grate plates of a static grate 31 of a clinker cooler 30. The static grate 31 of the clinker cooler 30 has an inclined surface, and the clinker C1 dropped on it slides down along a layer of clinker on the static grate 31 and is carried downward along grate plates of a mobile grate 32 which reciprocates. The clinker C1 is quickly cooled by cooling air injected through holes or slits formed on the grate plates.

It is not shown in the drawing but a plurality of high-pressure air injectors, which comprise an air tank on an outside wall side and nozzles connected to the air tank and pierced through the side wall of the clinker cooler 30, are disposed on a side wall on the side of the static grate 31 of the clinker cooler 30 and determined to have a sequence to periodically inject high-pressure air from the nozzles into the clinker cooler 30 to prevent the clinker, coating and the like from accumulating abnormally on the static grate 31.

In the aforesaid conventional cement clinker burning system, however, when coating adheres to the inside wall of the kiln 20 and its adhesion grows, a large lump of coating separates sometimes to drop into the clinker cooler 30. A position where the large lump of coating C2 drops is often far from the inside wall of the clinker cooler 30, namely far from the nozzles of the high-pressure air injector. Therefore, there is a problem that the large lump of coating C2 stays where it was dropped without sliding down to the mobile grate 32 even if high-pressure air is injected. The same remedy is also required because the clinker accumulates to become so large as to form a large lump. Besides, the large lump of coating C2 sometimes has a weight of several tons, and when it drops in the vicinity of the nozzles of the high-pressure air injector, its removal by high-pressure air is difficult.

Therefore, high-pressure water is conventionally injected into the clinker cooler 30 by a worker as required to break the large lumps of coating C2 on the static grate 31 so to remove them to the mobile grate 32. For the removal work by high-pressure water, a worker opens a manhole of the clinker cooler 30 and holds a nozzle of a high-pressure water hose to eject the high-pressure water to the large lumps of coating C2 retained on the static grate. Therefore, similar to the removal work of the large lumps of coating C2 by high-pressure air, there is a problem that the removing efficiency is considerably low when the large lumps of coating C2 are far way from the nozzle.

In addition, it is difficult to automate the work because the large lumps of coating C2 are not uniform in size and shape. The removal work by high-pressure water is manually performed, and because radiant heat is not normal but very severe in the cooler having a high temperature of 1000° C. or more, the work environment is extremely bad. Besides, fragments of a high temperature are scattered from the large lumps of coating C2 broken by high-pressure water, and steam is produced explosively because water is injected to the high-temperature large lumps of coating C2. Thus, the danger of suffering from contusion and burn is high for the worker. Besides, the danger of rupture of the pipe due to a damage or the like is high because the high-pressure water has a pressure of about several tens of MPa. Thus, there are disadvantages that it is necessary to perform maintenance of respective components such as pipes regularly at a short cycle, and maintenance and management are costly.

Accordingly, the present invention was achieved in view of the aforesaid existing problems. And it is an object of the invention to provide an apparatus for removing large lumps of coating, which can remove large lumps of coating retained on a static grate with reliability without manually working, can automate the removing work and excels in maintenance and management.

DISCLOSURE OF THE INVENTION

In order to achieve the aforesaid object, the apparatus for removing large lumps of coating of the present invention is an apparatus for removing at least one large lump of coating, which moves a large lump of coating discharged from a kiln for burning cement clinker, dropped onto and retained on a static grate cooler, from the static grate to a mobile grate and removes from the static grate, characterized by having pushing rods for pushing the large lumps of coating retained on the static grate and a drive means for making a pushing and pulling operation of the pushing rods.

The apparatus for removing large lumps of coating of the present invention has the drive means which is provided with a guide means for guiding the pushing and pulling operation of the pushing rods from the static grate side to the mobile grate side.

The apparatus for removing large lumps of coating of the present invention is provided with a cooling means for cooling the pushing rods.

The apparatus for removing large lumps of coating of the present invention is provided with a detecting means for detecting a flow rate of the cooling means, and a control means which does not start the pushing and pulling operation of the pushing rods or suspends the pushing and pulling operation to set back the pushing rods according to a detected result by the detecting means.

The apparatus for removing large lumps of coating of the present invention is provided with a monitoring means for monitoring what is on the static grate and a protection shutter for protecting a lens section of the monitoring means by operating at predetermined time intervals.

By configuring as described above, the apparatus for removing large lumps of coating makes the drive means perform the pushing and pulling operation of the pushing rods, so that the large lumps of coating retained on the static grate are pushed by the pushing rods when the drive means is activated. In other words, the large lumps of coating dropped from the kiln and retained on the static grate can be pushed by the leading ends of the pushing rods and removed onto the mobile grate.

The apparatus for removing large lumps of coating has the pushing and pulling operation of the pushing rods guided from the static grate side to the mobile grate side by the guide means. Therefore, reliability of pushing the large lumps of coating staying on the static grate by the leading ends of the pushing rods is high.

The apparatus for removing large lumps of coating has the pushing rods cooled by the cooling means, so that the pushing rods, which protrude into the clinker cooler and exposed to the high-temperature atmosphere, can be delayed from being degraded and can also maintain a sufficient strength in the high-temperature atmosphere.

Besides, the apparatus for removing large lumps of coating is controlled so that the pushing and pulling operation of the pushing rods is not started or the pushing and pulling operation is suspended to set back the pushing rods when the cooling water has a flow rate lower than a predetermined value. Therefore, the pushing rods can be effectively prevented from being deformed or degraded due to boiling of the cooling water within the pushing rods.

And, the apparatus for removing large lumps of coating monitors what is on the static grate by the monitoring means, so that what is on the static grate can be always monitored, and large lumps of coating can be found early without fail. The lens of the monitoring means is protected from flying substances such as clinker, coating and the like by the protection shutter for covering the lens at predetermined time intervals. Thus, the lens can be prevented from being broken or contaminated, and the frequency of maintenance for replacement, cleaning and the like of the lens can be decreased.

BEST MODE FOR CARRYING OUT THE INVENTION

Embodiments of an apparatus for removing large lumps of coating of the present invention will be described with reference to the accompanying drawings.

Figure 1:
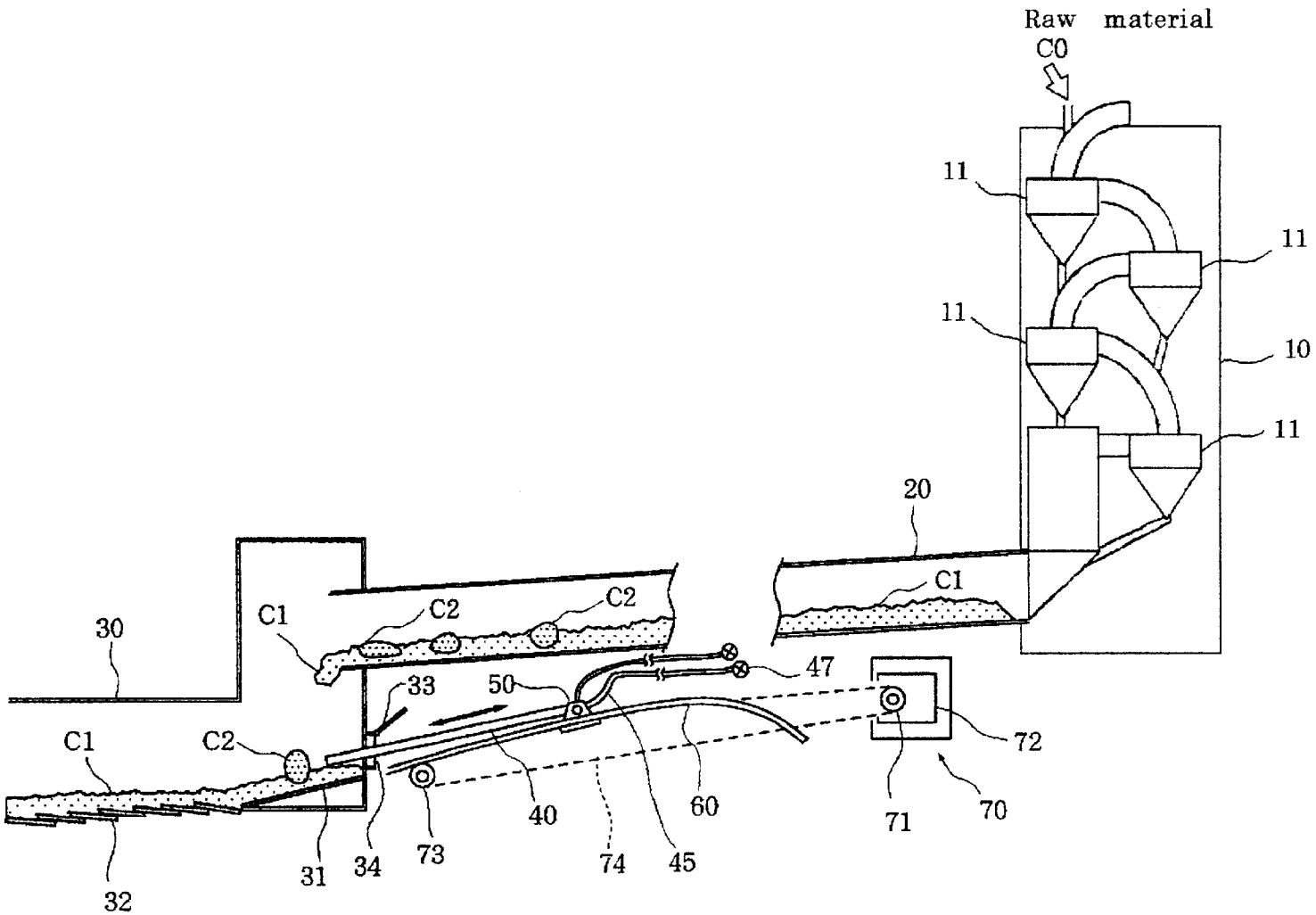
FIG. 1 is a structure diagram of cement clinker burning equipment provided with an apparatus for removing large lumps of coating showing a first embodiment of the present invention.
Figure 2:
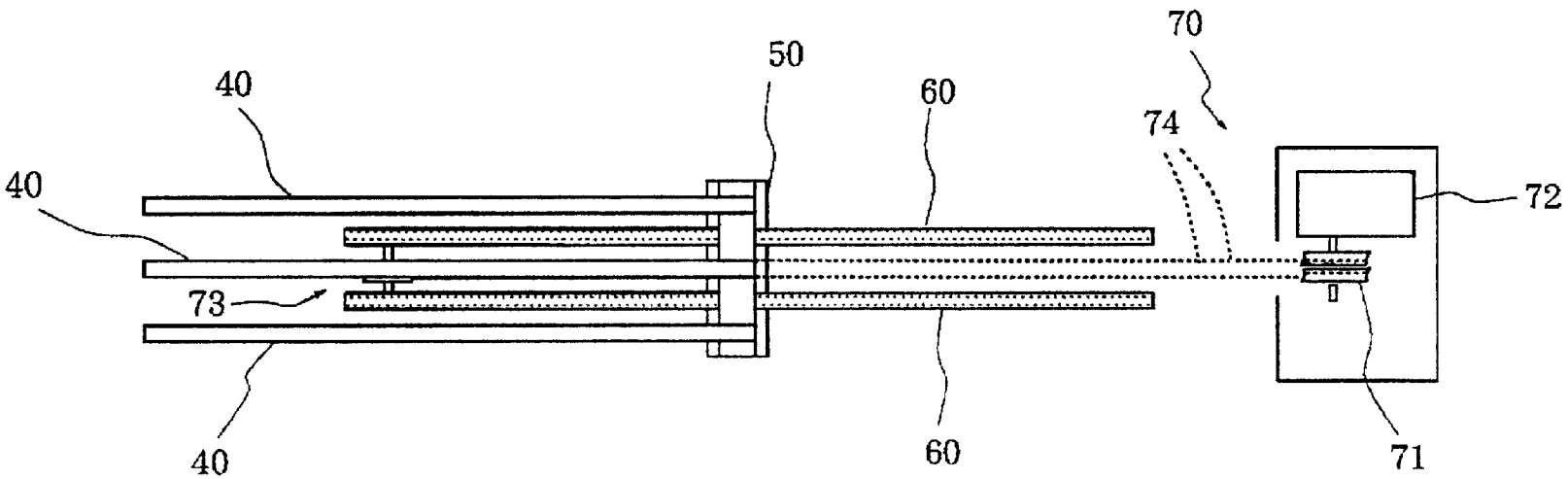
FIG. 2 is a plan view of the apparatus for removing large lumps of coating of FIG. 1.
Figure 3:
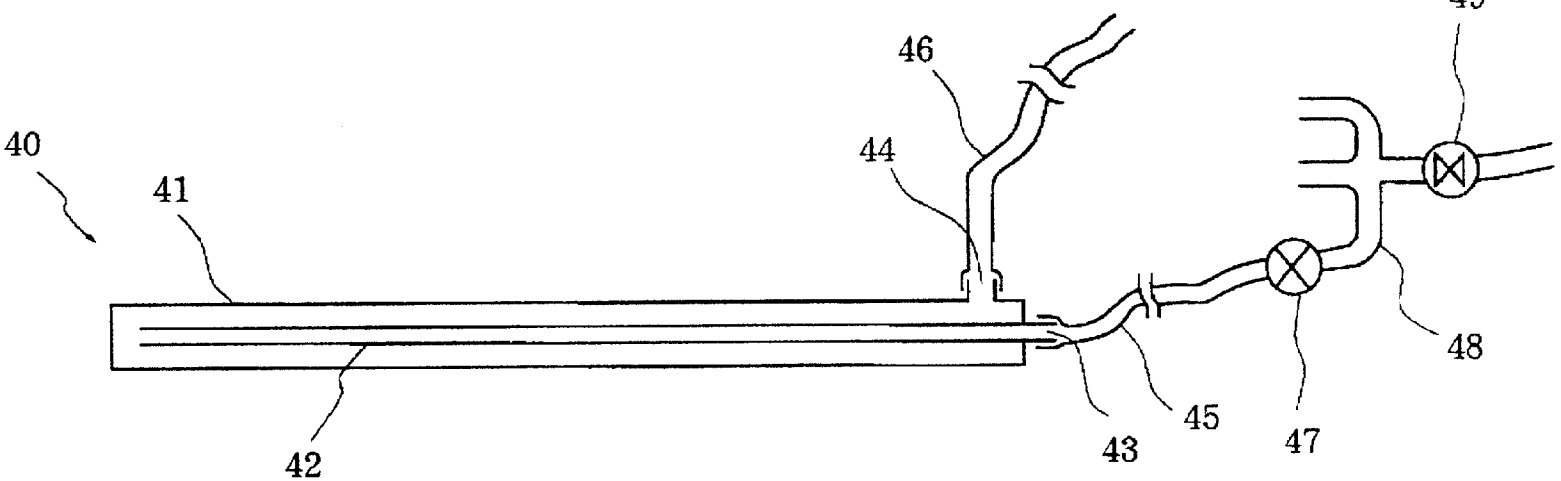
FIG. 3 is a sectional view of pushing rods shown in FIG. 1 and FIG. 2.

FIGS. 1 to 3 show a first embodiment of the present invention. FIG. 1 is a structure diagram of cement clinker burning equipment using the apparatus for removing large lumps of coating of the present invention, FIG. 2 is a plan view of the apparatus for removing large lumps of coating shown in FIG. 1, and FIG. 3 is a sectional view of pushing rods shown in FIG. 1 and FIG. 2.

Figure 7:
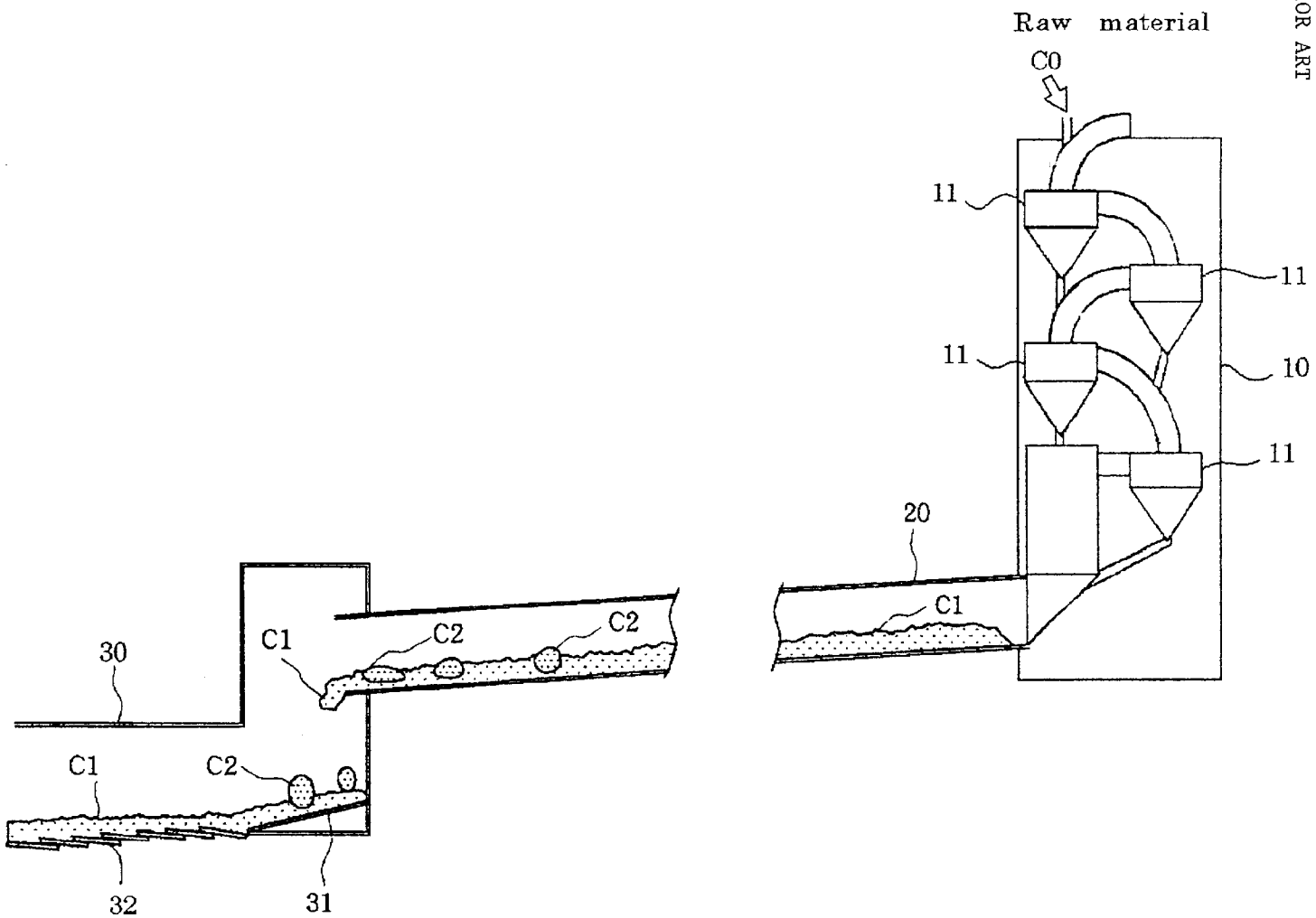
Fig 7 PRIOR ART
FIG. 7 is a structure diagram showing an example of conventional cement clinker burning equipment.

This cement clinker burning system comprises a suspension preheater 10 for heating raw materials, a kiln 20 for burning and a clinker cooler 30 for cooling clinker C1, which are sequentially arranged in the same manner as a conventional one shown in FIG. 7.

Specifically, a raw material C0 is fed into the suspension preheater 10, preheated to a predetermined temperature and taken into the kiln 20. Then, the clinker C1 is discharged as the kiln 20 rotates so to drop onto a static grate 31 of the clinker cooler 30. The dropped clinker C1 slides down toward a mobile grate 32 downstream of the static grate 31 and is conveyed along grate plates during which the clinker C1 is cooled quickly by an air flow. For the grate plates of the static grate 31, for example, KIDS made by IKN, Mulden plates made by BMH or the like may be used. High-pressure air is periodically injected into the clinker cooler 30 by a plurality of high-pressure air injection devices (not shown).

The apparatus for removing large lumps of coating of the present invention is attached to the clinker cooler 30 and comprises pushing rods 40, a support base 50, guide rails 60 and a drive unit 70. The clinker cooler 30 is provided with a door 33 on the wall at the upper part of the slope of the static grate 31, a seal material 34 disposed on an opening is seen when the door 33 is opened, the pushing rods 40 are pierced through the seal material 34 so to push large lumps of coating C2 retained on the static grate 31. The door 33 is opened and closed by a drive mechanism (not shown). A sequence is determined so that the door 33 which is generally closed is opened by operating a switch for activating the drive unit 70.

The position where the door 33 is installed is not particularly limited, but it is preferable to have the door 33 at a level so that the pushing rods 40 are supported by a layer of the clinker 1C on the static grate 31 and an excessive force is not applied to the pushing rods 40.

A hopper may be disposed below the door 33 to recover portions of the clinker C1 leaked from the clinker cooler 30 when the pushing rods 40 are started to operate or the seal material 34 is deteriorated, damaged or the like. The recovered clinker C1 can be supplied to a conveyor which is generally disposed below the clinker cooler 30, so that it is recovered without additional establishment of large scale equipment.

When the clinker cooler 30 has a large width, the apparatus for removing large lumps of coating of the present invention may be added in a plurality of units to the clinker cooler 30. For example, two apparatuses for removing large lumps of coating may be added in the width direction to the clinker cooler 30 and the pushing rods of each apparatus can be operated independently, so that undesired insertion of the pushing rods 40 is prevented and their degradation and damage can be delayed.

The pushing rods 40 are generally long rods having a circular cross section and have their rear ends pivotably connected to the support base 50. And, the support base 50 is movably engaged with the guide rails 60 so that it is moved by the drive unit 70. The pushing rods 40 may be square, rhombus, oval or the like in cross section as required.

The circular cross section according to the embodiment provides a minimum surface area, can contribute to the decrease of heat conducted to the pushing rods 40 even in a little amount, and it is easy to produce.

The pushing rods 40 may be disposed by only one but preferably be arranged in multiple numbers so that the large lumps of coating C2 can be pushed regardless of where they drop and the large lumps of coating C2 can be pushed without fail. In this embodiment, the three pushing rods 40 are laterally arranged at predetermined spacing as shown in FIG. 2. This spacing of arrangement is preferably determined to be smaller than a minimum size of the large lumps of coating C2 which might stay, namely the spacing of about 1 m or smaller in view of a general size of the large lumps of coating C2.

The pushing rods 40 may be arranged as required and can be arranged on the same line. In addition, they may be arranged up and down double, vertexes of an equilateral triangle or the like as viewed from the front of the pushing rods 40, so that an area to be pushed is increased lengthwise to stably push out the large lumps of coating C2.

The guide rails 60 are disposed in parallel with the inclination of the static grate 31. By disposing in this way, the pushing rods 40 can be reciprocally moved from the static grate 31 side with respect to the mobile grate 32 side so to remove the large lumps of coating C2 without fail. When there is a sufficient installation space, the guide rails 60 may be extended linearly, but it is sometimes difficult to have a sufficient space because there are the kiln 20 and its support above the installation space. Therefore, the guide rails of this embodiment are extended to rise and then curved downward at the rear portions of the rails. Thus, a small installation space below the kiln 20 can be used effectively, and the pushing rods 40 longer than when the guide rails 60 are linearly arranged can be disposed.

The installation place of the guide rails 60 is not particularly limited but they may be installed slantingly with respect to the extension line of the inclination of the static grate 31. The large lump of coating C2 tends to become large in a vertical direction with respect to the horizontal surface. Therefore, the present apparatus can be disposed on the side of the static grate 31 to push the large lumps of coating C2 sideways so to push them on the layer of the clinker C1 on the static grate 31, then the large lumps of fallen coating C2 can be removed toward the mobile grate 32 along the flow of the clinker C1.

And, the guide rails 60 are laterally arranged in two at predetermined spacing between them as shown in FIG. 2, and the support base 50 is movably engaged with the two rails. Rolling means such as bearings and tires are mounted between them to reduce the friction when moving.

The drive unit 70 comprises a power section which accommodates a drive wheel 71 and a drive motor 72, an interconnected wheel 73, and loop wire belts 74. Specifically, the interconnected wheel 73 and the main body are respectively disposed at the front and rear ends of the guide rails 60, and the wire belts 74 are put around the interconnected wheel 73 and the drive wheel 71. The drive wheel 71 is rotated by the drive motor 72 to rotate the wire belts 74 accordingly. The two wire belts 74 are put around side by side, and the drive wheel 71 and the interconnected wheel 73 are designed to have two parallel loop grooves. By disposing the two wire belts 74, even if one of them is broken when the pushing rods 40 protrude into the clinker cooler 30, the pushing rods 40 can be removed from the clinker cooler 30. And, these wire belts 74 are connected to the support base 50 on their way of loop. Therefore, the support base 50 is moved as the wire belts 74 are rotated, and the pushing rods 40 are guided by the guide rails 60 so to make a pushing operation.

The drive unit 70 is not limited to the aforesaid wire belt mechanism and may be changed as required to have a gear mechanism, a hydraulic mechanism, a pneumatic mechanism or the like.

The pushing rods 40 come into contact with the large lumps of coating C2, and their pushing force depends on a drive force exerted by the drive unit 70. In order to remove the large lumps of coating C2 efficiently without fail, it is preferable to determine each component of the drive system so that the pushing rods 40 have a pushing force of 200N to 100,000N. When the pushing force is less than 200N, even if the large lumps of coating C2 are found before they become very large, the large lumps of coating C2 may not be pushed because the drive force is too small to push them. When the pushing force exceeds 100,000N, a possibility of causing a problem of becoming a large apparatus, breaking respective components by abnormal situation, for example the pushing rods 40 are stuck, becomes higher than a possibility of improvement of the removal of the large lumps of coating C2. The atmosphere in the clinker cooler 30 has a high temperature of 1000° C. or higher, so that when a solid rod (e.g., SUS having a diameter of 90 mm) is used for the pushing rods 40, they are heated to be red hot and soft, possibly resulting in being deformed so not to perform the pushing operation. As shown in FIG. 3, the pushing rod 40 has a double tubular structure in which an inner tube 42 is concentrically disposed in a hollow outer tube 41 with its front and rear ends closed and protruded from the rear end to form a supply port 43 for the cooling water. A discharge port 44 for the cooling water is formed on the outer tube 41 in the vicinity of the supply port 43. The cooling water is fed through a supply pipe 45 connected to the supply port 43 and discharged through a discharge pipe 46 connected to the discharge port 44. Namely, the cooling water flows through the inner tube 42 of the double tube, reaches the leading end and returns between the outer tube 41 and the inner tube 42 and is discharged from the discharge port 44. By configuring as described above, the cooling water having a lower temperature can be supplied to the leading end which pushes the large lumps of coating.

The supply pipe 45 for the cooling water connected to each pushing rod 40 is provided with a flow rate adjuster 47, which adjusts as required to correct an unbalanced supply amount of the cooling water so to make the flow rate uniform. And, the respective flow rate adjusters 47 have their upstream sections collectively connected to a main water pipe 48 as shown in FIG. 3. The main water pipe 48 has a main valve 49 which is opened and closed to start and stop the water supply collectively. The respective supply pipes 45 and respective discharge pipes 46 are made of a flexible pipe so to follow the reciprocating operation of the pushing rods 40. Each pipe for water supply and discharge systems is made of a member having high pressure resistance and heat resistance so to be durable against increases in pressure and temperature due to probable boiling of the cooling water. In a case of use in a cold district, it is preferable that the respective pipes are made of a member which is not deteriorated by a low temperature. And it is desired to enable complete drain from the water supply and discharge systems so to prevent the pipes from being broken due to freezing.

The cooling water is determined to have an appropriate flow rate so that the pushing rods 40 can be cooled sufficiently without causing boiling in the pushing rods 40. If the cooling water boils, a cooling efficiency is considerably lowered, and the pushing rods 40 may be softened, deformed and degraded, and an inside pressure might abnormally increase to break respective components. Therefore, it is desired to secure a satisfactory flow rate, but flowing of the cooling water at a flow rate more than required does not provide a cooling effect as expected in spite of the flow rate. Thus, there are lots of waste and it is uneconomical. Therefore, it is necessary to determine the cooling water to have an appropriate flow rate.

Figure 4:
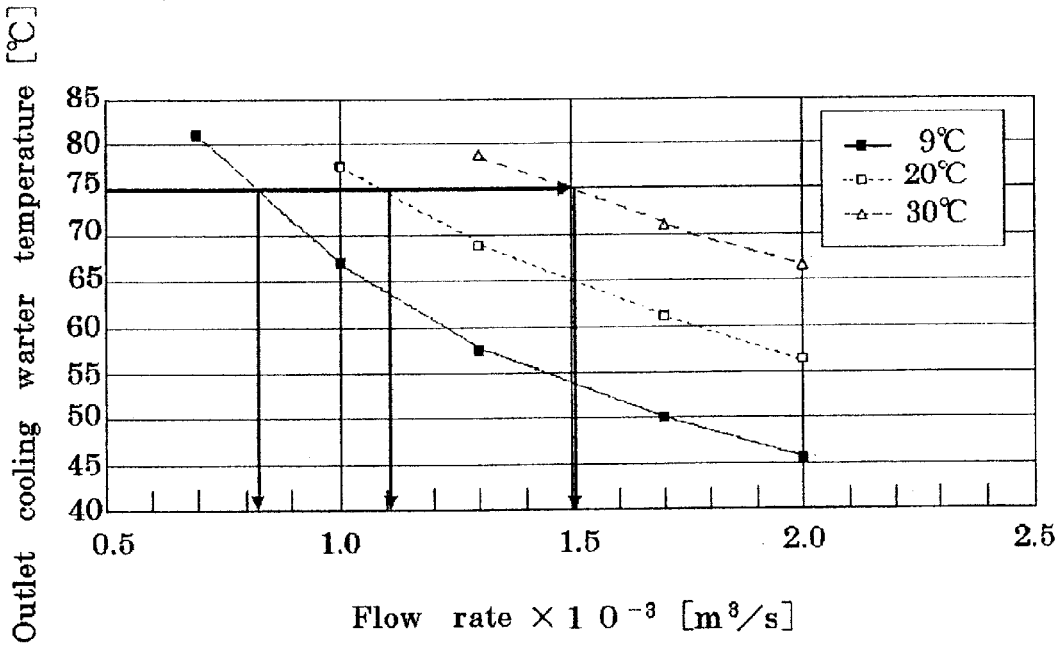
FIG. 4 is a graph showing a relation between cooling water flow rates and cooling water outlet temperatures.

Besides, in consideration of safety, the flow rate of the cooling water is preferably determined so that the pushing rods 40 can be cooled sufficiently without causing boiling within them even if they are caught in the clinker cooler 30. For example, FIG. 4 is a graph showing results obtained by measuring changes in temperature of water discharged from the pushing rods 40 with an inlet temperature of the cooling water determined as a predetermined value. The pushing rods 40 used had an outer diameter of 90 mm, an inside tube diameter of 34 mm and a length of 5 m, and considering that the inlet temperature of the cooling water was variable depending on seasons, the inlet temperature of the cooling water was determined to be 9° C., 20° C. and 30° C. And, changes in outlet temperature of the cooling water with respect to the flow rate of the cooling water were measured. Necessary minimum amounts of water for keeping the outlet temperature at 75° C. or below in view of safety were determined from FIG. 4 as shown in Table 1.

TABLE 1

| Weather | Winter | Spring & Autumn | Summer |
|---|---|---|---|
| Cooling water inlet temp. (° C.) | 9 | 20 | 30 |
| Minimum cooling water flow rate × $10^{-3}$ ($m^3/s$) | 0.8 | 1.1 | 1.5 |

In this embodiment, it is sequentially determined that the cooling water is specified to keep a flow rate at the above values or higher, the reciprocating operation is not started if a shortage of flow rate is detected by a flow rate sensor (not shown) before starting the reciprocating operation, and if a shortage of flow rate is detected after the reciprocating operation is started, the reciprocating operation is suspended, and the pushing rods 40 are retracted. When the reciprocating operation is suspended, the reciprocating operation may be restarted after the pushing rods 40 are retracted even a little, and the cooling water has a predetermined flow rate or its temperature lowers. To avoid the collision with the large lumps of clinker C2, it is desirable to retract the pushing rods 40 so to have the leading ends of the pushing rods 40 removed from the clinker cooler 30, and it is more desirable to retract them to an initial position.

And, it may be designed to attach a temperature sensor to the discharge port 44 for the cooling water, and if an abnormal increase in the outlet temperature of the cooling water is detected, the flow rate is increased, but if the temperature cannot be controlled, the aforesaid sequence by the flow rate sensor may be started. Besides, it may be determined to decrease the flow rate if the cooling water is being supplied excessively.

For the reciprocating operation of the pushing rods 40, it is desirable to operate them quickly by the drive unit 70 to prevent the pushing rods 40 from being deformed or broken by being hit by the large lumps of coating C2 falling down from the kiln 20, and the reciprocating operation of the pushing rods 40 is generally determined to complete in about one minute or less.

Besides, operation of the pushing rods 40 at a high speed allows to decrease duration when the pushing rods 40 remain in the clinker cooler 30 at a high temperature and to avoid an increase in temperature of the cooling water. In this embodiment, the flow rate of the cooling water is determined so that it does not boil in the pushing rods 40 even if the pushing rods 40 stay in the clinker cooler 30, while safety can be improved additionally by decreasing the insertion time of the pushing rods 40 in the clinker cooler 30.

Figure 5:
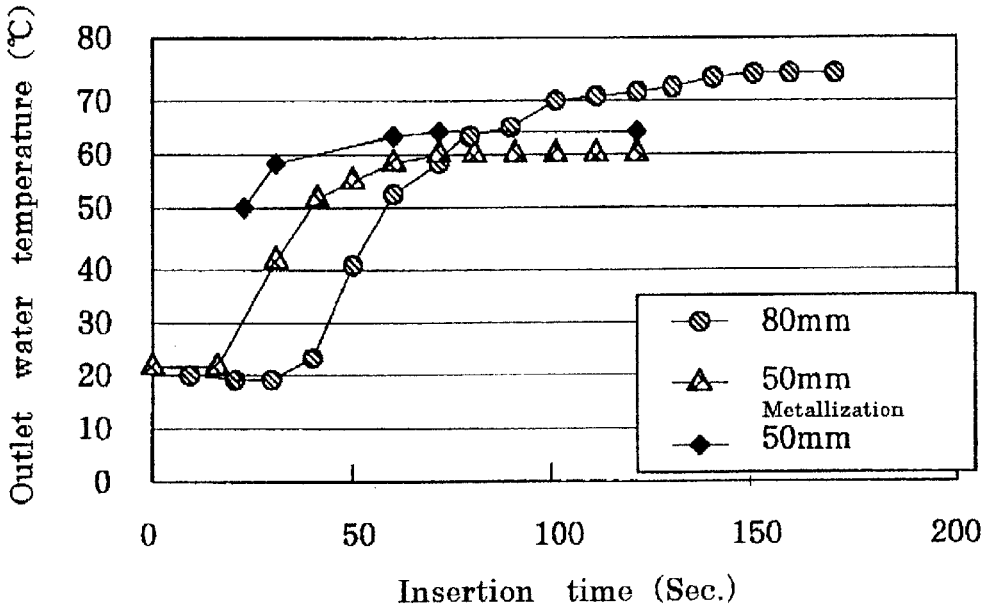
FIG. 5 is a graph showing a relation between pushing rod insertion duration and cooling water outlet temperatures.

For example, FIG. 5 is a graph showing the results obtained by measuring changes in temperature of the water discharged from the pushing rods 40 with the flow rate of the cooling water determined to a predetermined value. For the measurement, the pushing rods 40 used had an outer diameter of 80 mm, an inner tube diameter of 27 mm and a length of 5 m and an outer diameter of 50 mm, an inner tube diameter of 27 mm and a length of 5 m. Changes in temperature of the discharged water with respect to duration when the respective pushing rods 40 were inserted into the clinker cooler 30 were measured. It is apparent from FIG. 5 that the outlet water temperature becomes a steady state in about one minute when the pushing rod having the outer diameter of 50 mm is used and in about two minutes when the pushing rod having the outer diameter of 80 mm is used. It is desirable to complete the reciprocating operation of the pushing rods 40 before the outlet water temperature becomes a steady state, and it is desirable to complete the reciprocating operation of the pushing rods 40 in about one minute or less to avoid the cooling water from increasing in temperature.

A material for the pushing rods 40 is desired to have high heat resistance, and more desirably to be SUS for example. Furthermore, the surface of the pushing rod 40 made of SUS or the like may be treated by metallizing a highly heat-resistant material such as zirconia. Metallizing is preferably performed to have a thickness of about 1 mm or below. If the metallized thickness is greater than about 1 mm, the formed film is easily peeled when the pushing rods are used under a condition that a heat load is repeatedly applied. The improvement of heat resistance by the metallizing surface treatment was determined by measuring temperatures related to the flow rate of the cooling water by using a sample. Specifically, the sample was prepared by metallizing zirconia to a thickness of 0.6 mm on the surface of the pushing rod 40 having an outer diameter of 50 mm, an inside tube diameter of 27 mm and a length of 5 m. Changes in temperature of the discharged water were measured. As shown in FIG. 5, the temperature drop is apparent as compared with a non-metallized sample, and an effective heat-insulating effect can be obtained.

The pushing rods 40 may be determined to have an appropriate size considering a size of the large lump of coating C2 to be removed and easy handling of the apparatus, and it is desirable to have an outer diameter of about 50 to 300 mm and a length of about 2 to 10 m.

The outside tube 41 of the pushing rods 40 are also desirable to have a large thickness to keep a sufficient mechanical strength under high temperature and to suppress the cooling water from boiling. But, when they are thick more than necessary, cooling by the cooling water does not reach the surface of the pushing rods 40, and there is a possibility that the surface of the pushing rods 40 is deteriorated by heat of the clinker C1. From the aforesaid viewpoint, the outside tube 41 of the pushing rod 40 should have a thickness of about 2 to 30 mm.

By configuring as described above, the apparatus for removing large lumps of coating of this embodiment pushes the large lumps of coating C2 staying on the static grate 31 through the opening with the door 33 opened by activating the drive unit 70 to move the support base 50 as the wire belts 74 rotate, and performing the pushing and pulling operations of the support base 50, namely the pushing rods 40, which are guided by the guide rails 60. In other words, the large lumps of coating C2 having fallen from the kiln 20 and retained on the static grate 31 can be pushed by the leading ends of the pushing rods 40 so to be removed onto the mobile grate 32. A worker merely operates a switch for activating the drive unit 70. Thus, it is easy and free from a danger involved in removal according to the conventional manual work.

The pushing operation of the pushing rods 40 is based on a structure that the support base 50 is guided by the guide rails 60 and restricted to move from the static grate 31 side to the mobile grate 32 side by the aforesaid guide. Therefore, reliability of pushing the large lumps of coating C2 retained on the static grate 31 by the leading ends of the pushing rods 40 is high.

As a result, the large lumps of coating C2 can be removed easily with reliability, and cement can be produced with stability. Thus, its productivity can be improved.

Besides, the cooling water flows at a predetermined flow rate from the supply pipes 45 into the pushing rods 40 to cool them, and boiling of the cooling water in the pushing rods 40 due its shortage in amount is predicted by the flow rate sensor. If necessary, the outlet temperature of the cooling water is measured by the temperature sensor, and the pushing operation can be suspended, so that the pushing rods 40, which protrude into the clinker cooler 30 and exposed to the high-temperature atmosphere, can be maintained to have a sufficient strength and durability while its deterioration can be delayed. The pushing rods 40 are not always protruded into the clinker cooler 30. When the switch for activating the drive unit 7 is operated, the pushing rods 40 are fitted to the seal material 34 and protrude after the door 33 is opened according to the sequence setting. Thus, it is desirable to prevent degradation and breakage. Because the pushing rods 40 are fitted to the seal material 34 and protrude into the clinker cooler 30, no gap is formed, and high-temperature gas and the clinker C1 can be prevented from leaking.

Figure 6:
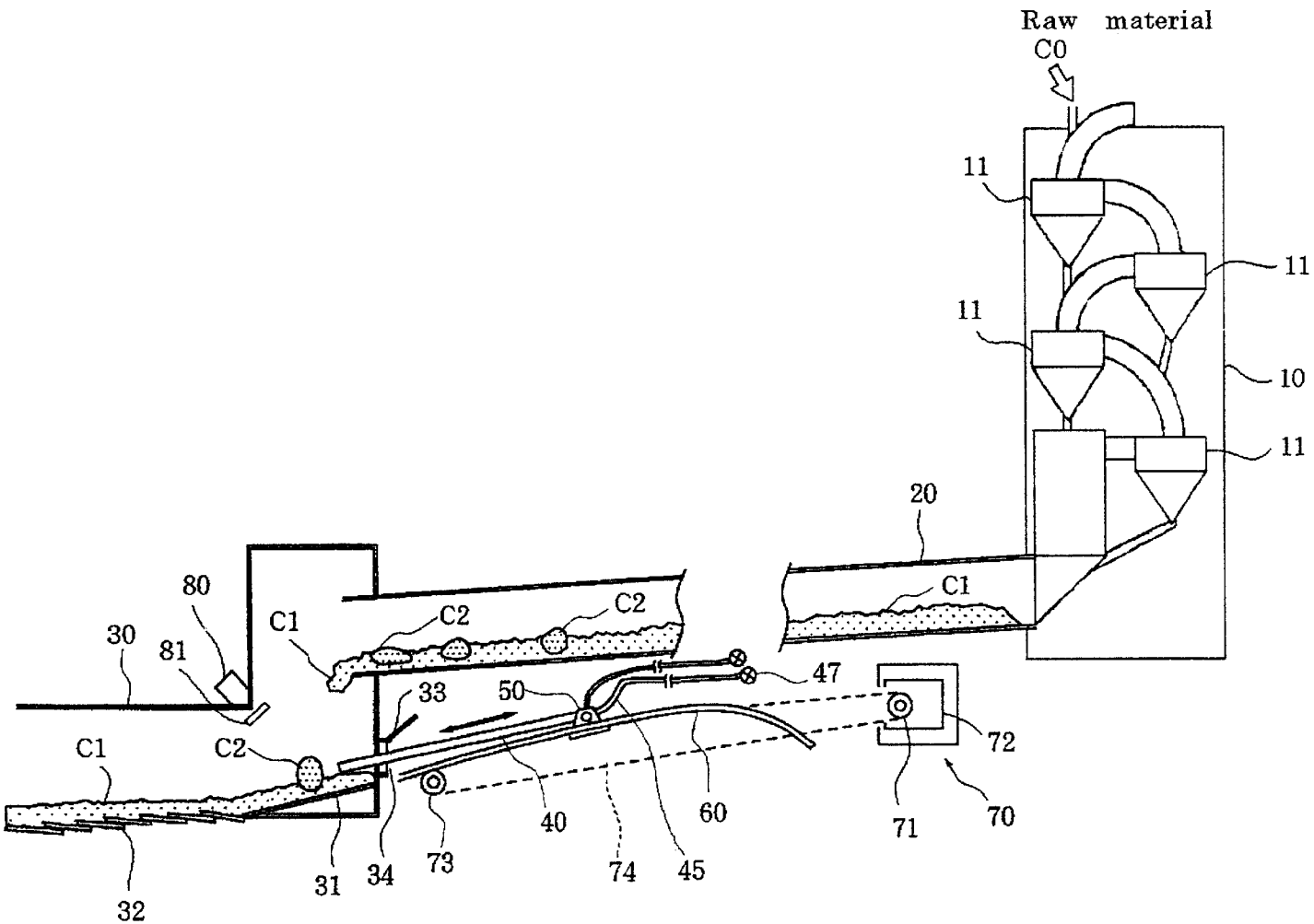
FIG. 6 is a structure diagram of an apparatus for removing large lumps of coating showing a second embodiment of the present invention.

FIG. 6 shows a second embodiment of the present invention. It is a structure diagram of a cement clinker burning system using the apparatus for removing large lumps of coating of the present invention. Like reference numerals are used to designate like or corresponding parts of the first embodiment, and the overlapping description is omitted.

A CCD camera 80, which has a structure usable in a high-temperature atmosphere, is disposed at a position from where the static grate 3 of the clinker cooler 3 can be monitored. The CCD camera 80 has a protection shutter 81 for protecting its lens.

The protection shutter 81 does not normally cover the lens so that the image on the static grate 31 in the clinker cooler 30 taken by the CCD camera 80 is monitored through a display monitor. But, clinker rises up within the clinker cooler 30 because of a high-pressure air blast by a high-pressure air injector (not shown) and falling of large lumps of coating C2 onto the static grate 31 or the like, and flying substances might contaminate or break the lens of the CCD camera 80. Therefore, it is designed in this embodiment to cover the lens of the CCD camera 80 by the protection shutter 81 when the flying substances are produced so to protect the lens from the flying substances. Specifically, the protection shutter 81 is operated according to a sequence that it is closed to cover the lens of the CCD camera 80 before the high-pressure air injector is operated and opened to reveal the lens of the CCD camera 80 after a lapse of a predetermined duration after the high-pressure air injector is operated. Thus, the lens of the CCD camera 80 can be protected from the flying substances.

The protection shutter 81 may have any shape as far as it can fully cover the lens of the CCD camera 80 and can be a flat plate of circular, square or the like. A material for the protection shutter 81 is desired to be highly heat resistant, and for example, a heat-resistant alloy, Incoloy 800H (Mitsubishi Materials Corporation), can be used. A drive mechanism for the protection shutter 81 is not limited particularly. For example, a support shaft connected to the drive motor is connected to the center at the edge of the protection shutter of a square flat plate, and the protection shutter is opened and closed by turning it by 90 degrees.

By configuring as described above, the CCD camera 80 monitors what is on the static grate 31, so that monitoring of the static grate 31 can be made with higher reliability than made by a visual inspection. Besides, the large lumps of coating C2 can be found without fail and early. The protection shutter 81 which operates at predetermined time intervals can protect the lens of the CCD camera 80 from flying substances of the clinker, coating and the like. Thus, the lens can be prevented from being broken or contaminated, and a maintenance frequency for replacement, cleaning and the like of the lens can be decreased. Therefore, monitoring by a worker is facilitated, and high-temperature dangerous work is decreased. Thus, it is advantageous and excellent in view of maintenance and management. As a result, cement can be produced stably, and its productivity can be improved further more.

A camera capable of making a heat image analysis may be installed instead of the CCD camera 80. The surface temperature of the large lumps of coating is lower than that of the layer of clinker on the cooler, and the camera capable of making a heat image analysis can catch low-temperature portions in the image. Therefore, a sequence can be determined so that when there is caused an area having a temperature lower than a predetermined value, it is recognized as a large lump of coating and the pushing rods are automatically operated. Thus, the pushing rods can be operated without depending on the monitoring by a worker. In such a case, a temperature at which the pushing roads are operated may be determined as required depending on where the camera is installed. In order to prevent false recognition of a low-temperature portion caused by accident within the cooler, it is preferable to set a sequence that if the low-temperature portion is present for a predetermined duration, e.g., five minutes or more, it is recognized as a large lump of coating.

INDUSTRIAL APPLICABILITY

As described above, the apparatus for removing large lumps of coating of the present invention provides the following excellent effects.

(1) The apparatus for removing large lumps of coating makes a drive means to perform the pushing and pulling operation of the pushing rods, so that the large lumps of coating retained on the static grate are pushed by the pushing rods when the drive means is activated. In other words, the large lumps of coating dropped from the kiln and retained on the static grate can be pushed by the leading ends of the pushing rods and removed onto the mobile grate. To do so, a worker is merely required to operate the switch for activating the drive means. It is easy and free from a danger that might be caused by conventional work of manually removing them.

(2) The apparatus for removing large lumps of coating has the pushing and pulling operation of the pushing rods guided and restricted from the static grate side to the mobile grate side by the guide means. Therefore, reliability of pushing the large lumps of coating retained on the static grate by the leading ends of the pushing rods is high.

As a result, the large lumps of coating can be removed easily with reliability, so that cement can be produced stably and its productivity can be improved.

(3) The apparatus for removing large lumps of coating has the pushing rods cooled by the cooling means, so that the pushing rods, which protrude into the clinker cooler and exposed to the high-temperature atmosphere, can be delayed from being degraded and maintain its durability. And, the pushing rods can also maintain a sufficient strength in the high-temperature atmosphere.

(4) The apparatus for removing large lumps of coating is controlled so that the pushing and pulling operation of the pushing rods is not started or the pushing and pulling operation is suspended to set back the pushing rods when the cooling water has a flow rate lower than a predetermined value. Therefore, the pushing rods can be effectively prevented from being deformed or degraded due to boiling of the cooling water within the pushing rods. Thus, higher safety can be secured.

(5) The apparatus for removing large lumps of coating monitors what is on the static grate by the monitoring means, so that what is on the static grate can be always monitored, and large lumps of coating can be found without fail and early. The lens of the monitoring means is protected from flying substances such as clinker, coating and the like by the protection shutter for covering the lens at predetermined time intervals. Thus, the lens can be prevented from being broken or contaminated, and the frequency of maintenance for replacement, cleaning and the like of the lens can be decreased. Accordingly, it is remarkable because monitoring by a worker becomes easy, high-temperature dangerous work is decreased, and maintenance and control can be made advantageously. As a result, cement can be produced more stably, and its productivity can be further improved.

What is claimed is:

1. An apparatus for removing at least one large lump of coating, which was discharged from a rotary kiln for burning cement clinker, dropped onto and retained on a static grate cooler, from the static grate to a mobile grate, the static grate and mobile grate enclosed in a clinker cooler characterized by having a plurality of spaced pushing rods for pushing the large lumps of coating retained on the static grate, cooling means for cooling the pushing rods, and a drive means for making a pushing and pulling operation of the plurality of pushing rods into and out of the clinker cooler.

2. The apparatus for removing at least one large lump of coating according to claim 1, wherein the drive means is provided with a guide means for guiding the pushing and pulling operation of the pushing rods.

3. The apparatus for removing large lumps of coating according to claim 1 or 2, further comprising a monitoring means for monitoring what is on the static grate and a protection shutter for covering a lens section of the monitoring means at predetermined time intervals.

4. An apparatus for removing at least one large lump of coating which was discharged from a rotary kiln for burning cement clinker, dropped onto and retained on a static grate cooler, from a static grate to a mobile grate, characterized by having pushing rods for pushing the at least one large lump of coating retained on the static grate and a drive means for making a pushing and pulling operation of the pushing rods;

cooling means for cooling the pushing rods; and a detecting means for detecting a flow rate of the cooling means, and a control means which does not start the pushing and pulling operation of the pushing rods or suspends the pushing and pulling operation to set back the pushing rods according to a detected result by the detecting means.

5. The apparatus for removing at least one large lump of coating according to claim 4, wherein the drive means is provided with a guide means for guiding the pushing and pulling operation of the pushing rods.

6. An apparatus for removing at least one large lump of coating which was discharged from a rotary kiln for burning cement clinker, dropped onto and retained on a static grate cooler, from a static grate to a mobile grate, characterized by having pushing rods for pushing the at least one large lump of coating retained on the static grate;

a drive means for making a pushing and pulling operation of the pushing rods;

a monitoring means for monitoring what is on the static grate; and a protection shutter for covering a lens section of the monitoring means at predetermined time intervals.

7. The apparatus for removing at least one large lump of coating according to claim 6, wherein the drive means is provided with a guide means for guiding the pushing and pulling operation of the pushing rods from the static grate side to the mobile grate side.

* * * * *